US006966688B2

(12) United States Patent
Lins

(10) Patent No.: US 6,966,688 B2
(45) Date of Patent: Nov. 22, 2005

(54) APPARATUS FOR MIXING AND DISPENSING POWDER

(75) Inventor: Claudio L. K. Lins, Racine, WI (US)

(73) Assignee: JohnsonDiversey, Inc., Sturtevant, WI (US)

( * ) Notice: Subject to any disclaimer, the term of this patent is extended or adjusted under 35 U.S.C. 154(b) by 0 days.

(21) Appl. No.: 11/064,327

(22) Filed: Feb. 23, 2005

(65) Prior Publication Data

US 2005/0141339 A1 Jun. 30, 2005

Related U.S. Application Data

(63) Continuation-in-part of application No. 10/189,946, filed on Jul. 3, 2002, now abandoned.

(51) Int. Cl.[7] ..... B01F 15/02

(52) U.S. Cl. ..... 366/142; 366/152.4; 366/163.2; 366/168.1; 366/181.2; 366/181.3; 366/182.3; 366/182.4; 366/183.2

(58) Field of Search ..... 366/142, 152.4, 366/155.1, 163.2, 168.1, 181.2, 181.3, 182.3, 366/182.4, 183.2, 191; 137/888; 239/142, 239/398

(56) References Cited

U.S. PATENT DOCUMENTS

| | | | | |
|---|---|---|---|---|
| 3,740,027 | A | 6/1973 | Kormos | |
| 3,776,702 | A | 12/1973 | Chant | |
| 3,901,724 | A | 8/1975 | White | 127/22 |
| 3,931,914 | A | 1/1976 | Hosaka et al. | |
| 3,986,706 | A | 10/1976 | Giombini | |
| 4,120,051 | A | 10/1978 | Lohning | 366/142 |
| 4,298,168 | A | 11/1981 | Rozmus | 239/659 |
| 4,426,156 | A | 1/1984 | Adamo et al. | 366/156.1 |
| 4,450,983 | A | 5/1984 | Goodrich | 222/196 |
| 4,629,093 | A | 12/1986 | LeMolaire | 222/40 |
| 4,705,217 | A | 11/1987 | Hartley et al. | 239/142 |
| 4,723,691 | A | 2/1988 | Minkevitch et al. | 222/210 |
| 4,778,280 | A | 10/1988 | Brazelton | 366/136 |
| 4,782,984 | A | 11/1988 | Su | 222/456 |
| 4,811,869 | A | 3/1989 | Tremblay | 222/440 |
| 4,824,295 | A | 4/1989 | Sharpless | 406/109 |
| 5,238,154 | A | 8/1993 | Zuriel | 222/189.06 |
| 5,344,142 | A | 9/1994 | Barreira | |
| 5,344,619 | A | 9/1994 | Larwick et al. | 422/261 |
| 5,522,660 | A | 6/1996 | O'Dougherty et al. | 366/136 |
| 5,564,825 | A | 10/1996 | Burt | 366/175.2 |
| 5,603,340 | A | 2/1997 | Gueret | 132/293 |
| 5,615,830 | A | 4/1997 | Matsunaga et al. | 239/8 |

(Continued)

FOREIGN PATENT DOCUMENTS

WO WO 01/14244 A1 3/2001

OTHER PUBLICATIONS

One page from a Beta product brochure published in the 1980's showing the Encapsulator.

(Continued)

*Primary Examiner*—David Sorkin
(74) *Attorney, Agent, or Firm*—Gregory S. Bollis; James J. Sales; Neil E. Hamilton

(57) ABSTRACT

An apparatus and method for mixing and dispensing a powder material in an aqueous solution wherein the powder material is premixed into solution by a spreader. The premix solution is subsequently dispensed in a diluted aqueous stream by a venturi proportioner. In a preferred manner a hopper is provided for the powder material which is partially positioned in a mixing chamber. A valve and spreader are positioned at the base of the hopper.

7 Claims, 1 Drawing Sheet

U.S. PATENT DOCUMENTS

| | | | | |
|---|---|---|---|---|
| 5,725,131 | A | 3/1998 | Bell et al. | 222/196 |
| 5,868,326 | A | 2/1999 | Speegle | 239/654 |
| 5,934,343 | A | 8/1999 | Gaylo et al. | 141/12 |
| 6,217,654 | B1 | 4/2001 | Mauchle et al. | 118/308 |
| 6,290,386 | B1 | 9/2001 | Baumgartl et al. | 366/160.1 |
| 6,294,605 | B1 | 9/2001 | Suzuki et al. | 524/494 |
| 6,672,755 | B1 * | 1/2004 | Potter et al. | 366/175.2 |
| 2004/0004903 | A1 * | 1/2004 | Lins | 366/142 |

OTHER PUBLICATIONS

One page from a Johnson Wax Professional product brochure published in 1998 showing the J-Fill Sprayer Dispenser.

One page from a S.C. Johnson Professional product brochure published at least as early as May 1997 showing the J-Fill Portable Dispensing Unit.

* cited by examiner

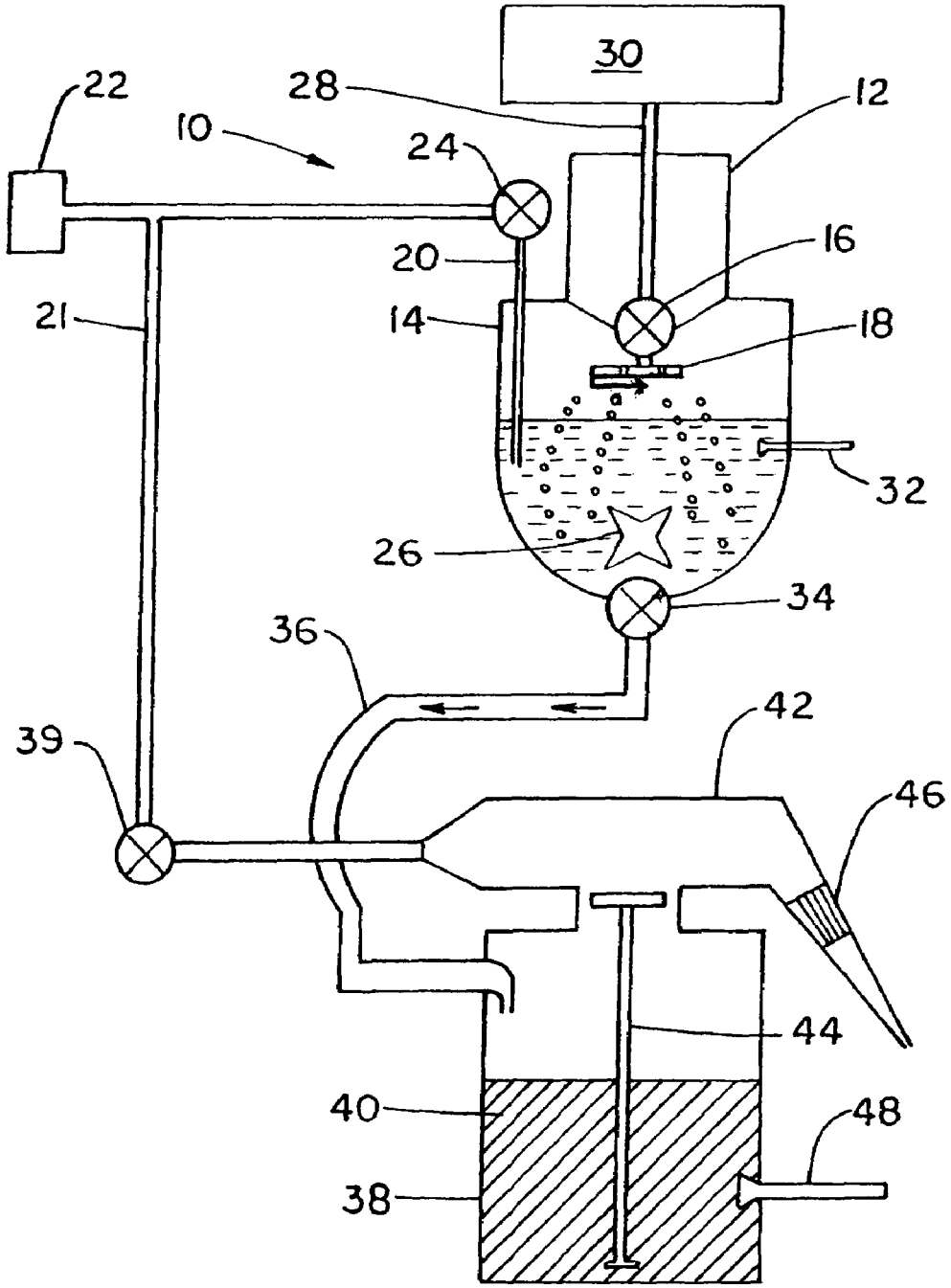
30
22
28
12
10
24
16
20
21
14
18
32
26
34
36
42
39
46
44
40
48
38

APPARATUS FOR MIXING AND DISPENSING POWDER

CROSS-REFERENCE TO RELATED APPLICATIONS

This application is a Continuation-In-Part of U.S. application Ser. No. 10/189,946, filed 3 Jul. 2002, now abandoned.

STATEMENT REGARDING FEDERALLY SPONSORED RESEARCH OR DEVELOPMENT

NONE

BACKGROUND OF THE INVENTION

1. Technical Field

This invention relates generally to the preparation of solutions from a powder material. More particularly, it relates to the mixing of a powder material to provide an aqueous premix and dispensing the premix.

2. Background Art

The mixing of powder material with water to provide an aqueous solution with accurate amounts of the powder material poses problems. For example the powder material must be uniformly distributed in the aqueous solvent. This is a particular problem with respect to powder materials which are not readily solubilized. Further care must be exercised to determine that the correct amount of powder material is employed with the aqueous solvent.

U.S. Pat. No. 5,615,830 discloses a powder dispensing system including a powder supply hopper 12 communicating with a conveying member 16 having powder receiving cavities which conveys the powder to a chamber 18 where an ejector nozzle 22 discharges the powder to a powder spray apparatus 28.

U.S. Pat. Nos. 5,868,326 and 5,934,343 show various types of powder dispensing apparatus with hoppers such as 26 and 11, respectively, and feed rollers such as 16 and 14, respectively.

U.S. Pat. Nos. 4,120,051 and 5,564,825 show diverters for mixing purposes such as the motor driven spreader or deflection means D in the '051 patent and the flow diverter 58 disclosed in the '825 patent.

The prior art does not provide an apparatus for mixing a powder material into an aqueous solvent to form a concentrated premix so that an accurate and uniform amount of the powder material is present in the solvent. Neither does the prior art provide for the delivering of the concentrated premix in a diluent stream of water.

The objects of the invention therefore are:

Providing an improved mixing and dispensing apparatus for a powder material.

Providing a mixing and dispensing apparatus which affords the accurate introduction of amounts of the powder material in an aqueous solvent.

Providing a mixing and dispensing apparatus which provides for an efficient mixing and dispensing of the powder material in a solution.

Providing a mixing and dispensing apparatus of the foregoing type which is easily controlled.

Providing a mixing and dispensing apparatus of the foregoing type which is operable from a common water source.

Providing an improved method of mixing a powder material into an aqueous solution and dispensing the solution.

SUMMARY OF THE INVENTION

The foregoing objects are accomplished and the shortcomings of the prior art are overcome by the apparatus of this invention which in one embodiment mixes and dispenses a powder material in a solution. The apparatus includes a mixing chamber and a hopper for a powder material. The hopper is positioned adjacent the mixing chamber. A powder spreader is constructed and arranged to spread the powder material into the mixing chamber. A portion of the powder spreader is positioned essentially centrally within the mixing chamber and rotatable in a horizontal plane to spread the powder material into the mixing chamber. A first water conduit is connected to the mixing chamber. There is a product chamber with a product conduit interconnecting the mixing chamber and the product chamber. An eductor member is connected to the product chamber. A second water conduit is connected to the eductor to draw product from the product chamber and dispense it.

In a preferred embodiment, a portion of the hopper is placed inside the mixing chamber and the mixing chamber includes a mixing device.

In another preferred embodiment, the mixing chamber and product chamber include a conductivity sensor.

In one aspect, the first and second water conduits are interconnected as a unitary conduit.

In another aspect, a metering tube is connected to the eductor.

The method of this invention includes mixing and dispensing a powder material wherein a powder material is spread in a first chamber and the powder material is mixed with water, to provide a concentrate. The concentrate is introduced into a second chamber and concentrate is dispensed from the second chamber.

These and still other objects and advantages of the invention will be apparent from the description which follows. In the detailed description below a preferred embodiment of the invention will be described in reference to the full scope of the invention. Rather, the invention may be employed in other embodiments.

BRIEF DESCRIPTION OF DRAWING

FIG. 1 is a diagrammatic view of the apparatus of this invention.

DESCRIPTION OF THE PREFERRED EMBODIMENT

Referring to FIG. 1 the apparatus generally 10 for mixing and dispensing a powder material includes a hopper 12 in which is placed a powder material such as dry percarbonates and perborates that generate hydrogen peroxide. The hopper 12 extends a short distance into a mixing chamber 14 and houses a valve 16 for introducing the powder material onto a spreader 18. Water is introduced into the mixing chamber 14 by means of water conduit 20 connected to water source 22. Valve 24 controls the flow of water to mixing chamber 14.

A mixing stirrer 26 is provided in chamber 14. Stirrer 26 is driven by shaft 28 connected to motor 30. A conductivity sensor 32 is positioned in the mixing chamber 14. Sensor 32 is pre-set for a pre-determined concentration of the powder in the mixing chamber 14 and will control, by suitable controls, the opening of hopper valve 16 and the activation of motor 30. Shaft 28 will also activate the spreader 18 to rotate it in a horizontal plane. This is shown by the directional arrow. After the amount and concentration of powdered-material is introduced into chamber 14 and dispersed therein, hopper valve 16 is closed and the pre-mix chamber valve 34 located at the base of chamber 14 is opened. Premixed concentrated solution flows through conduit 36 and into product chamber 38.

When all of the concentrated solution 40 is placed in product chamber 38, the chamber valve 34 is closed and water source valve 39 in water conduit 21 is opened. Concentrated solution is drawn into the venturi system proportioner 42 which includes an eductor 46 with an air gap for drawing solution through the restrictor tube 44. A preferred eductor is described in U.S. Pat. No. 5,927,338. Solution 40 is dispensed at a pre-set concentration controlled by the restrictor tube 44. Once product chamber 38 is emptied, conductivity sensor 48 which is connected through suitable controls closes water valve 39. The previously described method can then be repeated.

It will thus be seen that there is now provided a mixing and dispensing apparatus which by means of a spreader affords accurate and efficient introduction of amounts of powder material into an aqueous solvent. The apparatus is easily controlled by means of conductivity sensors 32 and 48.

While conductivity sensors 32 and 48 provide an easily controlled apparatus, they can be eliminated yet an efficient mixing apparatus is still afforded. Neither is it essential that a portion of the hopper 12 extend into the mixing chamber 14. Percarbonates and perborates were previously described as being the dry powder material to be introduced into mixing chamber 14. If desired, tetra acetyl ethylene diamine could be introduced to be activated with hydrogen peroxide to generate peroxygens. Dry enzymes could also be added. Any dry powder such as acids and bases which are moisture sensitive and react to provide a cleaning function could also be employed. Other variations and modifications of this invention will be obvious to those skilled in the art. This invention is not to be limited except as set forth in the following claims.

What is claimed is:

1. An apparatus for mixing and dispensing a powder material comprising:

a mixing chamber;

a hopper for a powder material, the hopper positioned adjacent the mixing chamber;

a first valve member positioned between the hopper and the mixing chamber;

a powder spreader constructed and arranged to spread the powder material into the mixing chamber, a portion of the powder spreader being positioned essentially centrally within the mixing chamber and rotatable in a horizontal plane to spread the powder material into the mixing chamber;

a first water conduit connected to the mixing chamber;

a product chamber;

a product conduit interconnecting the mixing chamber and the product chamber;

a second valve member positioned between the mixing chamber and the product chamber;

an eductor member connected to the product chamber; and a second water conduit connected to the eductor to draw product from the product chamber and dispense it.

2. The apparatus as defined in claim 1 wherein a portion of the hopper is placed inside the mixing chamber.

3. The apparatus as defined in claim 2 wherein the powder spreader includes a motor.

4. The apparatus as defined in claim 1 wherein the mixing chamber includes a mixing device.

5. The apparatus as defined in claim 1 wherein the mixing chamber and product chamber include a conductivity sensor.

6. The apparatus as defined in claim 1 wherein the first and second water conduits are interconnected as a unitary conduit.

7. The apparatus as defined in claim 1 wherein a metering tube is connected to the eductor.

* * * * *